US006438340B2

(12) United States Patent
Sato

(10) Patent No.: US 6,438,340 B2
(45) Date of Patent: Aug. 20, 2002

(54) DEVELOPING APPARATUS AND ASSEMBLING METHOD FOR THE SAME

(75) Inventor: Minoru Sato, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/832,954

(22) Filed: Apr. 12, 2001

(30) Foreign Application Priority Data

Apr. 21, 2000 (JP) ..... 2000-120703

(51) Int. Cl.[7] ..... G03G 15/08; G03G 21/16
(52) U.S. Cl. ..... 399/103; 156/73.1
(58) Field of Search ..... 399/103, 105, 399/111, 113; 29/428, 469; 156/73.1

(56) References Cited

U.S. PATENT DOCUMENTS 5,389,732 A * 2/1995 Sekino ..... 399/103
5,758,230 A * 5/1998 Nakaue et al. ..... 399/103
5,815,644 A 9/1998 Nishiuwatoko et al. ..... 399/113
6,181,898 B1 1/2001 Sato ..... 399/103

FOREIGN PATENT DOCUMENTS

JP 8-15940 1/1996

* cited by examiner

*Primary Examiner*—Joan Pendegrass
(74) *Attorney, Agent, or Firm*—Fitzpatrick, Cella, Harper & Scinto

(57) ABSTRACT

A developing apparatus includes a developer carrying body, a first frame having an opening and forming a part of a containing portion for containing the developer, a second frame joined to the first frame to cover the opening, wherein the second frame forms a part of the containing portion, and a sealing member for preventing leakage of the developer from a longitudinal end part of the developer carrying body. The sealing member is supported over the first and second frames, wherein the first and second frames are coupled together in a manner such that adjacent surfaces of the first and second frames for supporting the sealing member form substantially identical planes.

14 Claims, 13 Drawing Sheets

DEVELOPING APPARATUS AND ASSEMBLING METHOD FOR THE SAME

BACKGROUND OF THE INVENTION

1. Field of the Invention

The present invention relates to a developing apparatus provided with first and second frames, and an assembling method for this apparatus.

2. Related Background Art

An image forming apparatus employing an electrophotographic system includes a frame body for holding a toner containing portion provided to contain toner as developer, a developing portion provided to develop an electrostatic latent image on an image bearing body by using toner, or the like. Such frame body is referred to as a developing frame. Now, a conventional developing frame will be described by taking the example of one disclosed in Japanese Patent Application Laid-Open No. 8-15940, with reference to FIGS. 15 and 16.

A process cartridge shown in FIG. 15 includes a developing frame 100 for containing toner T, a photosensitive drum for carrying a latent image, a developing roller 100*c* for developing the latent image on the photosensitive drum by using the toner T, a charging roller for uniformly charging the photosensitive drum, cleaning means for removing residual toner on the photosensitive drum, and a gripping member provided in the upper side to be held by a user. The developing frame 100 is composed of a toner developing main body 101, and a toner developing wall member 102. A space formed by coupling both members 101 and 102 together is set as a toner containing portion 100*a*, and the toner T is fed from a toner supplying opening 110*a* to the developing roller 100*c* incorporated as a developer carrying body in a developing chamber 100*b*.

For coupling the toner developing frame body 101 and the toner developing wall member 102 to each other, first, both members 101 and 102 are joined together, and end parts 101*b* and 102*c* are welded to a toner wall portion 102*a* included in the joined portions. A developing wall portion 102*b* corresponding to the developing chamber 100*b* is not welded to the developing frame body 101 and, in both ends, a toner leakage preventing seal 105 is provided in a non-welded part between the developing wall portion 102*b* and the toner developer frame body 101. Also, as shown in FIG. 16, end members 103 and 104 are attached to both end parts of a longitudinal direction so as to position both members 101 and 102. In the described example, the members 101 and 102 are welded on one surface (toner wall portion 102*a*).

There is another conventional constitutional example for coupling both members 101 and 102 together, according to which all the joined portions of the members 101 and 102, i.e., even the developing wall portion 102*b*, may be welded for coupling. Thus, both members 101 and 102 can be firmly coupled together, preventing any positional shifting or the like even when a twisting force is applied. In this case, the toner leakage preventing seal 105 is not provided in the joined portion of the members 101 and 102 in the developing wall portion 102*b*. In other words, the members 101 and 102 are welded on two surfaces (the toner wall portion 102*a* and the developing wall portion 102*b*).

In the foregoing second conventional example, however, the welding joined portion of the toner developing frame body 101 and the toner developing wall member 102 is positioned in the end part of the developing roller 100*c*. As shown in FIG. 15, a sealing member 106 for preventing toner leakage is provided in the end part of the developing roller 100*c*. However, as the welding joined portion may easily become rugged, the welding of the sealing member 106 may become difficult, creating the possibility of deteriorating sealing performance.

SUMMARY OF THE INVENTION

Objects of the invention are to provide a developing apparatus capable of enhancing the sealing performance of a sealing member, and an assembling method for this apparatus.

Other objects of the invention are to provide a developing apparatus having substantially no stepped portions on a surface, on which a sealing member is supported, and an assembling method for this apparatus.

Yet other objects of the invention are to provide a developing apparatus advantageous in terms of component and assembling costs, and an assembling method for this apparatus.

DETAILED DESCRIPTION OF THE PREFERRED EMBODIMENTS

Next, description will be made of a developing apparatus and its assembling method according to the preferred embodiments of the invention with reference to the accompanying drawings.

(Entire Constitution)

Figure 1:
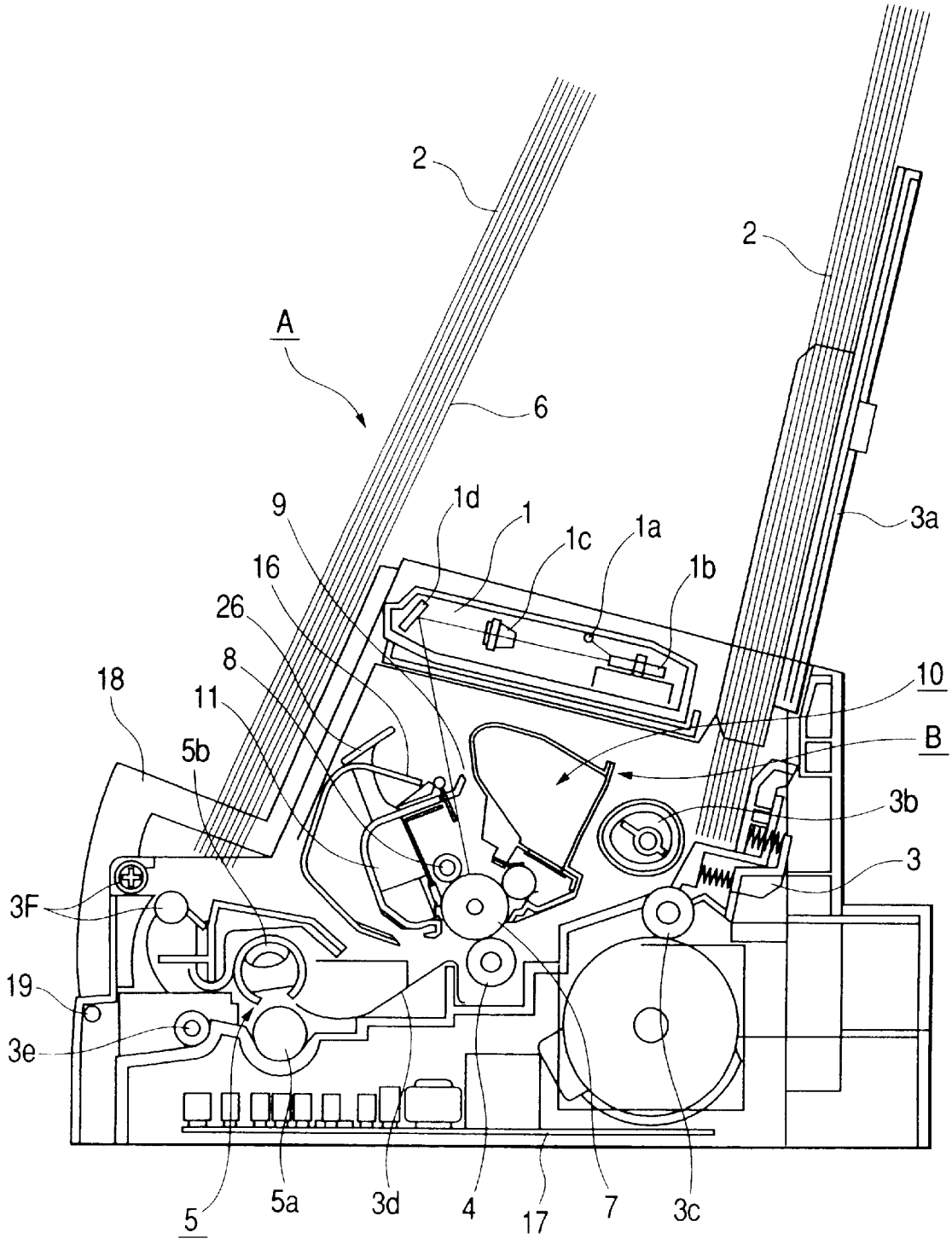
FIG. 1 is a view illustrating the entire constitution of an image forming apparatus.
Figure 2:
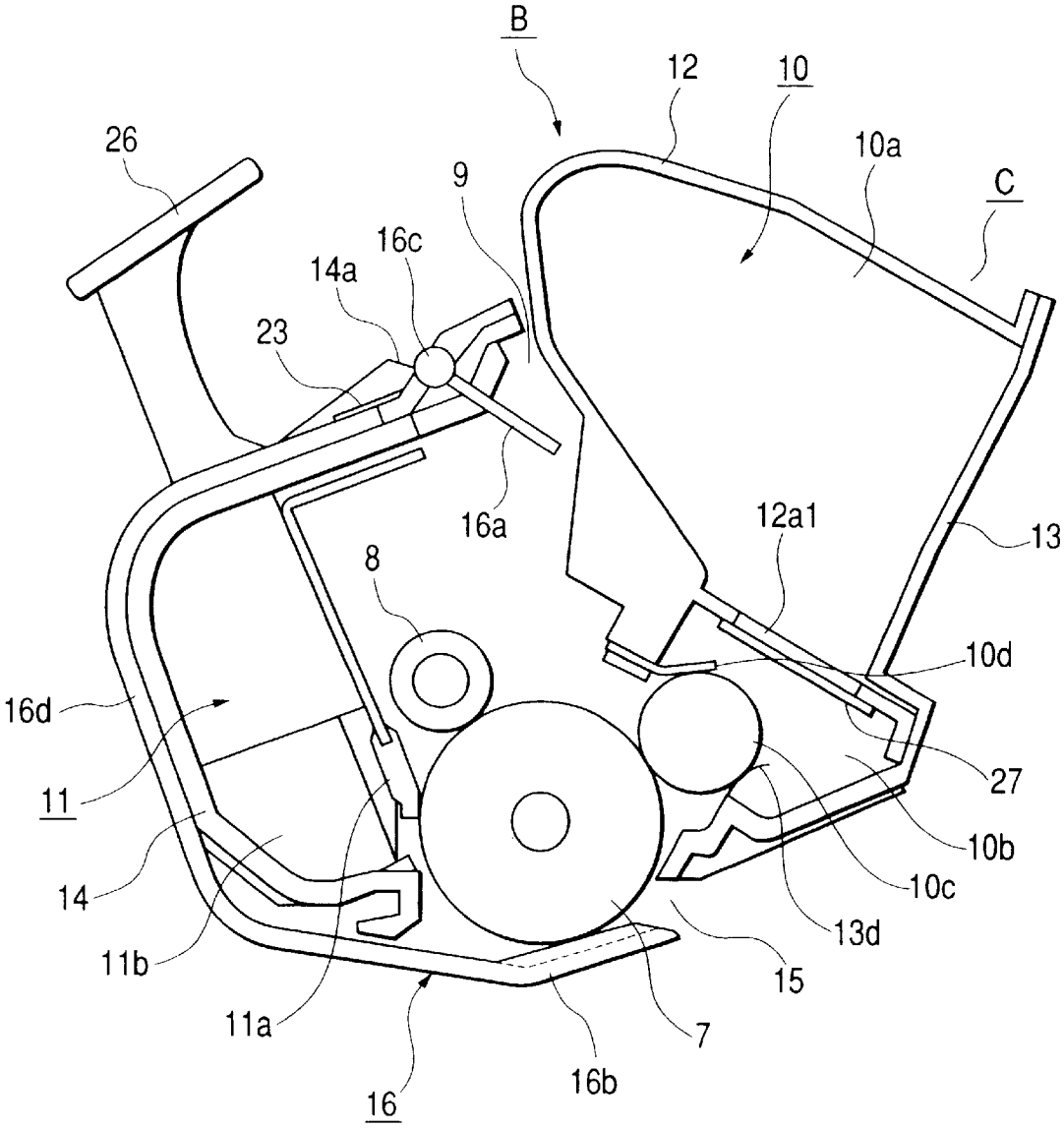
FIG. 2 is a view illustrating the constitution of a process cartridge.
Figure 3:
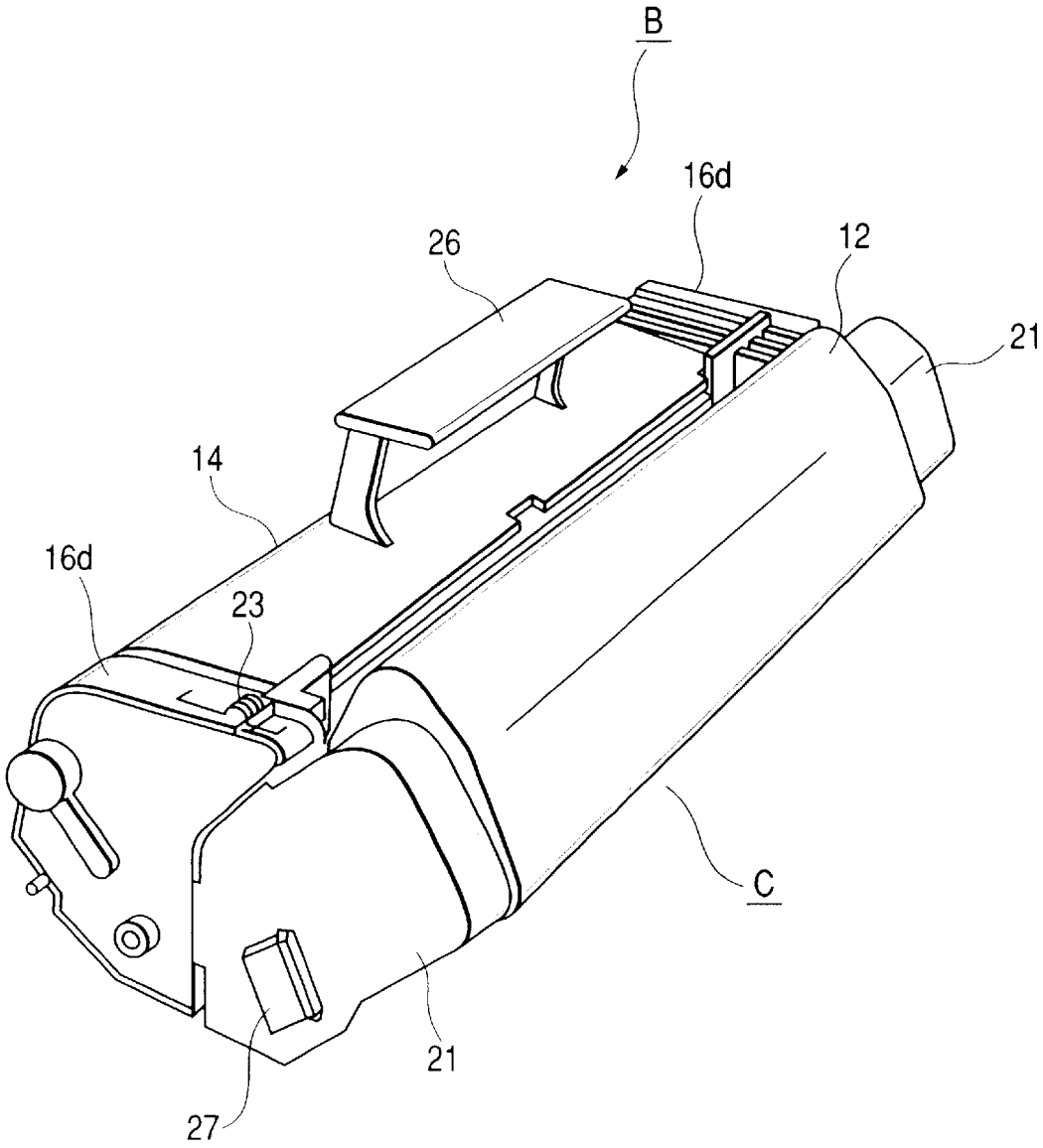
FIG. 3 is a view illustrating the constitution of the process cartridge.

First, by referring to FIGS. 1 to 4, the entire constitution of an electrophotographic image forming apparatus, and a process cartridge will be described. FIG. 1 illustrates the entire constitution of the image forming apparatus; FIGS. 2 and 3 the constitution of the process cartridge; and FIG. 4 the loaded state of the process cartridge in an apparatus main body. As shown in FIG. 1, the electrophotographic image forming apparatus A is adapted to form an image on a recording medium through an electrophotographic image forming process.

After the formation of a toner image on a drum-shaped electrophotographic photosensitive body (referred to as a photosensitive drum 7, hereinafter) as a later-described image bearing body, a recording medium 2 having been set in a feeding tray 3*a* in synchronization with the formation of the toner image is carried by carrying means 3 composed of a pickup roller 3*b*, a carrying roller 3*c*, and so on. The toner image formed on the photosensitive drum 7 is transferred to the recording medium 2 by applying a voltage having polarity opposite that of the toner image to a transferring roller 4 as transferring means. The recording medium 2 having the toner image transferred thereto is then conveyed to fixing means 5 by a guide 3*d*. This fixing means 5 is composed of a driving roller 5*a*, and a fixing roller 5*b* incorporating a heater, and serves to fix the transferred toner image by applying heat and pressure to the passing recording medium 2. Then, the recording medium 2 is reversed and conveyed by discharging rollers 3*e* and 3*f*, and discharged to a discharging tray 6.

(Process Cartridge)

As shown in FIGS. 1 to 3, a process cartridge denoted by B is constructed by housing the photosensitive drum 7, a charging roller 8, and so on, in a cartridge frame body. The cartridge frame body is constructed by coupling together a developing frame C composed of a toner developing frame body 12 and a toner developing wall member 13, and a cleaning frame body 14. Specifically, the toner developing frame body 12 and the toner developing wall member 13 are welded together to constitute a toner chamber 10*a* and a developing chamber 10*b*. A developing roller 10*c* and a developing blade 10*d* are attached to the developing chamber 10*b*. The photosensitive drum 7, the charging roller 8, and members constituting cleaning means 11 are attached to the cleaning frame body 14. In addition, above the upper surface of the cleaning frame body 14, a gripping member 26 is provided so as to be united with the frame body 14.

To form an image, first, the photosensitive drum 7 having a photosensitive layer as an image bearing body is rotated, and its surface is uniformly charged by applying a voltage to the charging roller 8 as charging means. Then, an optical system 1 emits a laser beam according to image information, and the photosensitive drum 7 is irradiated with this laser beam through an exposing opening 9 to form a latent image. The optical system 1 includes a laser diode 1*a*, a polygon mirror 1*b*, a lens 1*c* and a reflecting mirror 1*d*.

The latent image on the photosensitive drum 7 is developed by developing means 10 using toner, and thus the above-described toner image is formed. As shown in FIG. 2, the developing means 10 supplies toner in the toner chamber 10*a* to the developing chamber 10*b*, rotates the developing roller 10*c* attached to the developing chamber 10*b*, forms a toner layer having triboelectric charges applied thereto by the developing blade 10*d* on the surface of the developing roller 10*c* incorporating a fixed magnet, and then supplies the toner to the developing area of the photosensitive drum 7. The developing blade 10*d* regulates the amount of toner stuck to the peripheral surface of the developing roller 10*c*. This developing blade 10*d* is supported by a developing blade attaching portion 10*d*1 provided in the toner developing frame body 12. By transferring the toner to the photosensitive drum 7 according to the latent image, a toner image is formed to be visible.

After the transfer of the toner image formed on the photosensitive drum 7 to the recording medium 2 by the transferring roller 4, residual toner on the photosensitive drum 7 is removed by the cleaning means 11. In this case, the cleaning means 11 scratches off toner remaining on the photosensitive drum 7 by an elastic cleaning blade 11*a*, and stores the toner in a waste toner pit 11*b*.

The process cartridge B includes the exposing opening 9 for irradiating the photosensitive drum 7 with a laser beam from the optical system 1, and a transfer opening 15 for placing the photosensitive drum 7 oppositely to the recording medium 2. The transfer opening 15 is used to transfer the toner image formed on the photosensitive drum 7 to the recording medium 2. A shutter member 16 for opening/closing both openings 9 and 15 is attached to the outer surface of the process cartridge B.

The shutter member 16 is provided for preventing deterioration or the like caused by damage, dust stuck to the surface of the photosensitive drum 7 or the light of the photosensitive body. This shutter member 16 includes first and second shutter portions 16*a* and 16*b*, which are integrally provided respectively for opening/closing the exposing opening 9, and for opening/closing the transfer opening 15. The shutter member 16 has rotary supporting shafts 16*c* in both ends of a longitudinal direction, and the first shutter portion 16*a* is provided so as to incline obliquely downward from the rotary supporting shaft 16*c*. In addition, an arm portion 16*d* is formed, which is bent along the shape of the cleaning frame body 14 in a direction opposite the first shutter portion 16*a* from the rotary supporting shaft 16*c*. The second shutter portion 16*b* is provided to connect both arm portions 16*d*.

On the other hand, a bearing portion 14*a* for supporting the rotary supporting shaft 16*c* is provided in the upper side of the cleaning frame body 14, and the shutter member 16 is rotatably attached to the cleaning frame body 14. In this case, a twisting coil spring 23 is attached to one of the rotary supporting shafts 16*c* and, by this twist coil spring 23, the shutter member 16 is always pressed in the direction of closing the openings 9 and 15.

Figure 4:
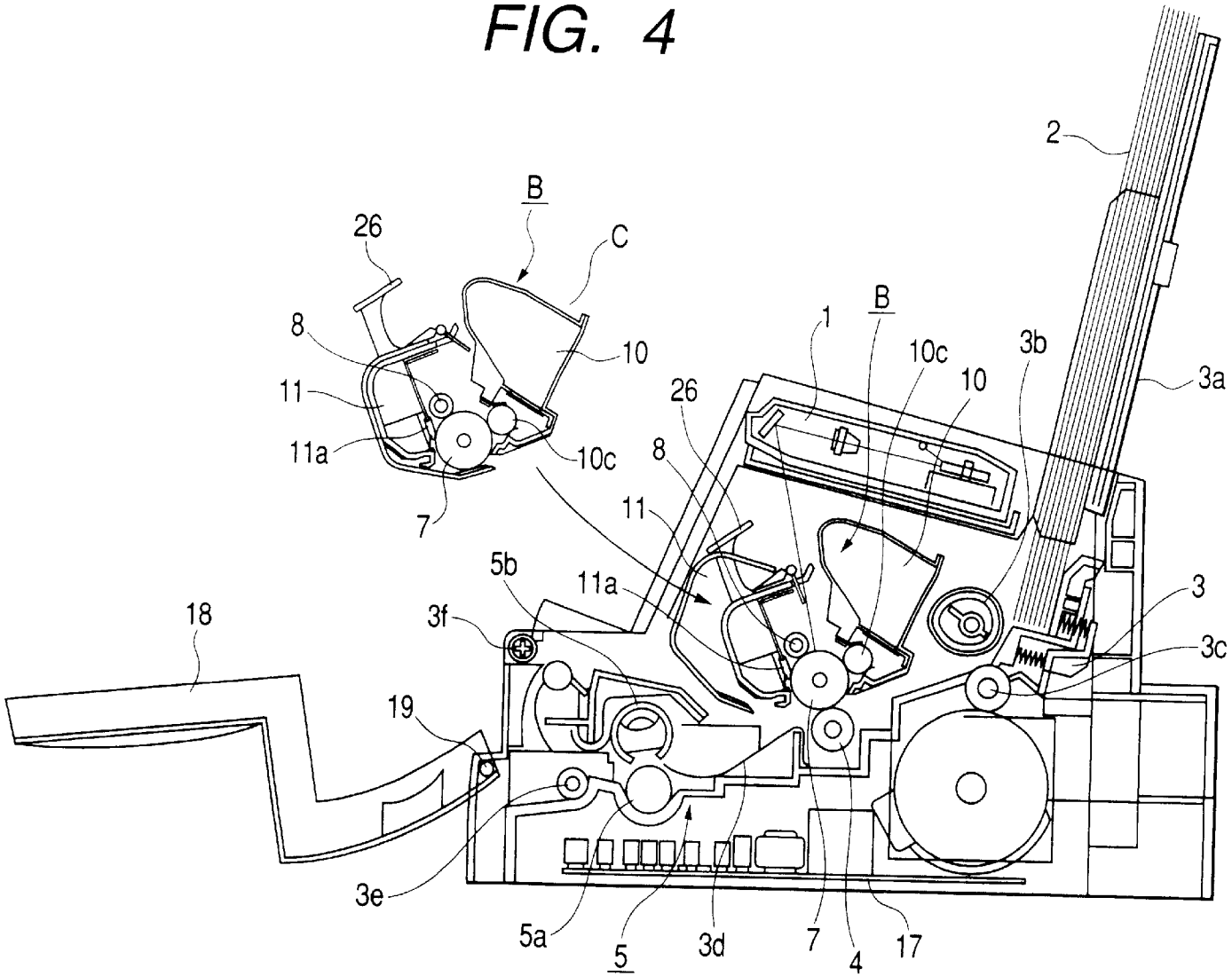
FIG. 4 is a view illustrating the loaded state of the process cartridge in an apparatus main body.

As shown in FIG. 4, the image forming apparatus A includes an opening/closing cover 18, which is attached to an apparatus main body 17 so as to be rotated around a shaft 19. As may be seen by opening the cover 18, inside the apparatus main body, a guiding member (not shown in the drawing) is provided for guiding the process cartridge B. An operator can attach/detach the process cartridge B along the guiding member.

(Constitution of Developing Frame)

Figure 5:
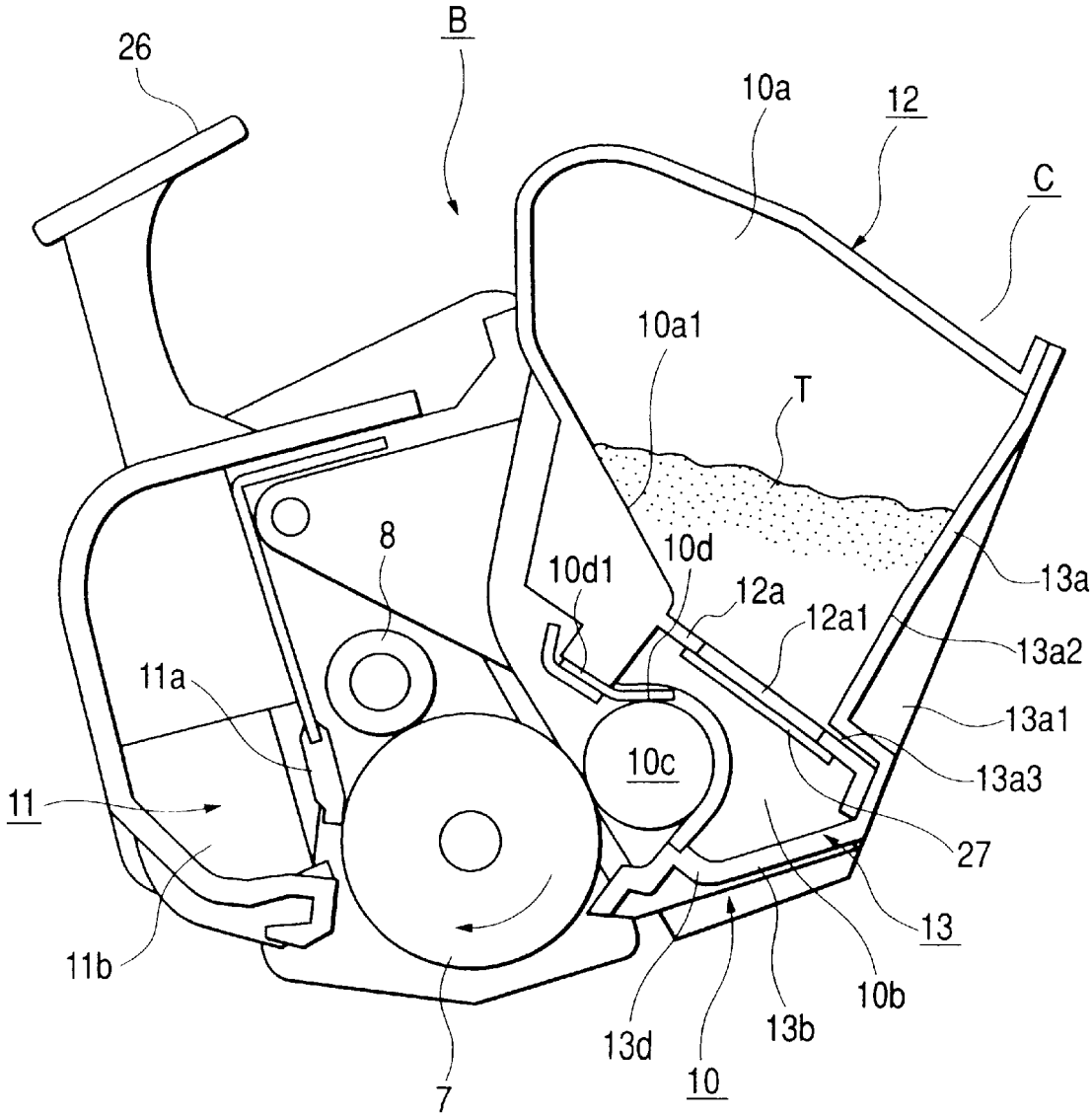
FIG. 5 is a sectional view illustrating developing means.
Figure 6:
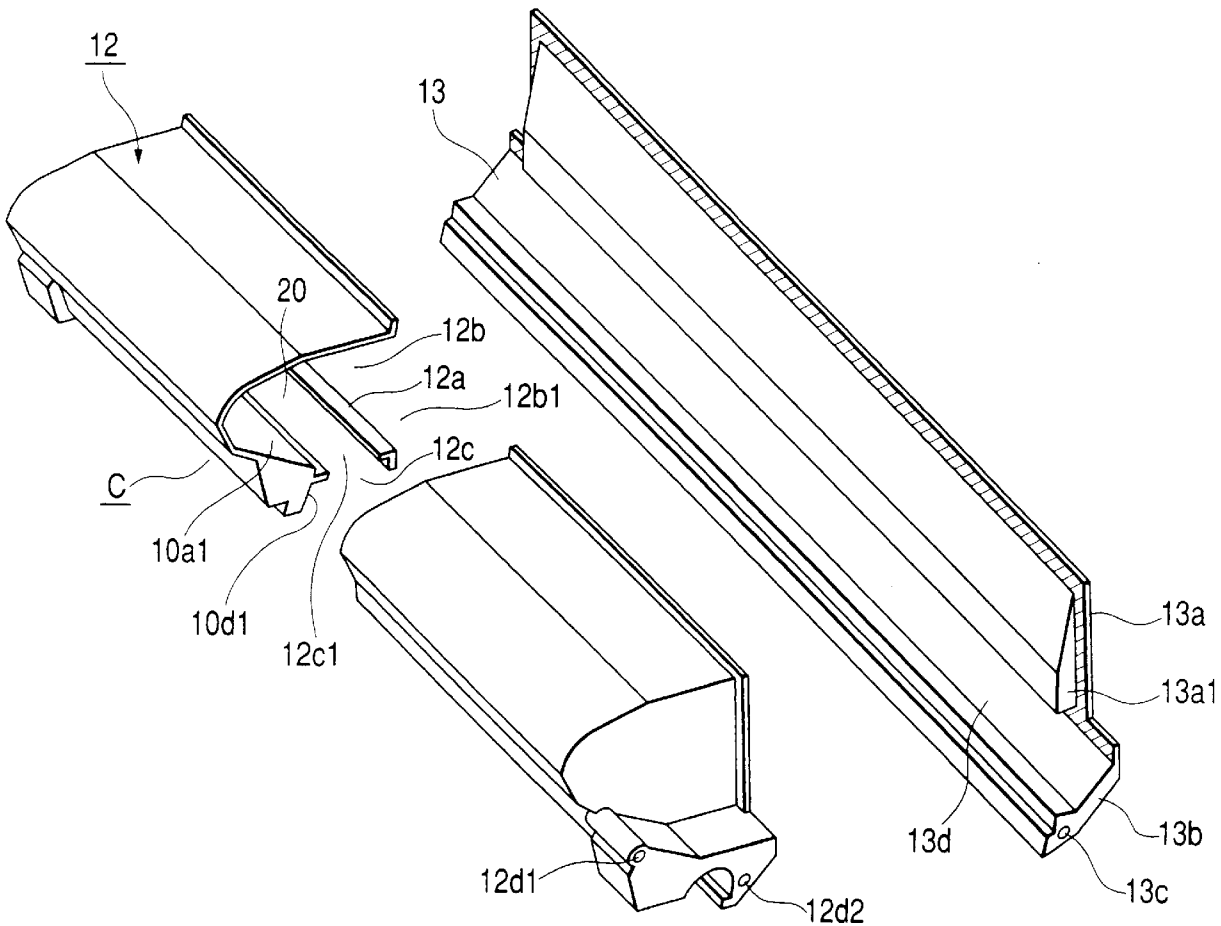
FIG. 6 is a view illustrating the separated state of a toner developing frame body and a toner developing wall member.
Figure 7:
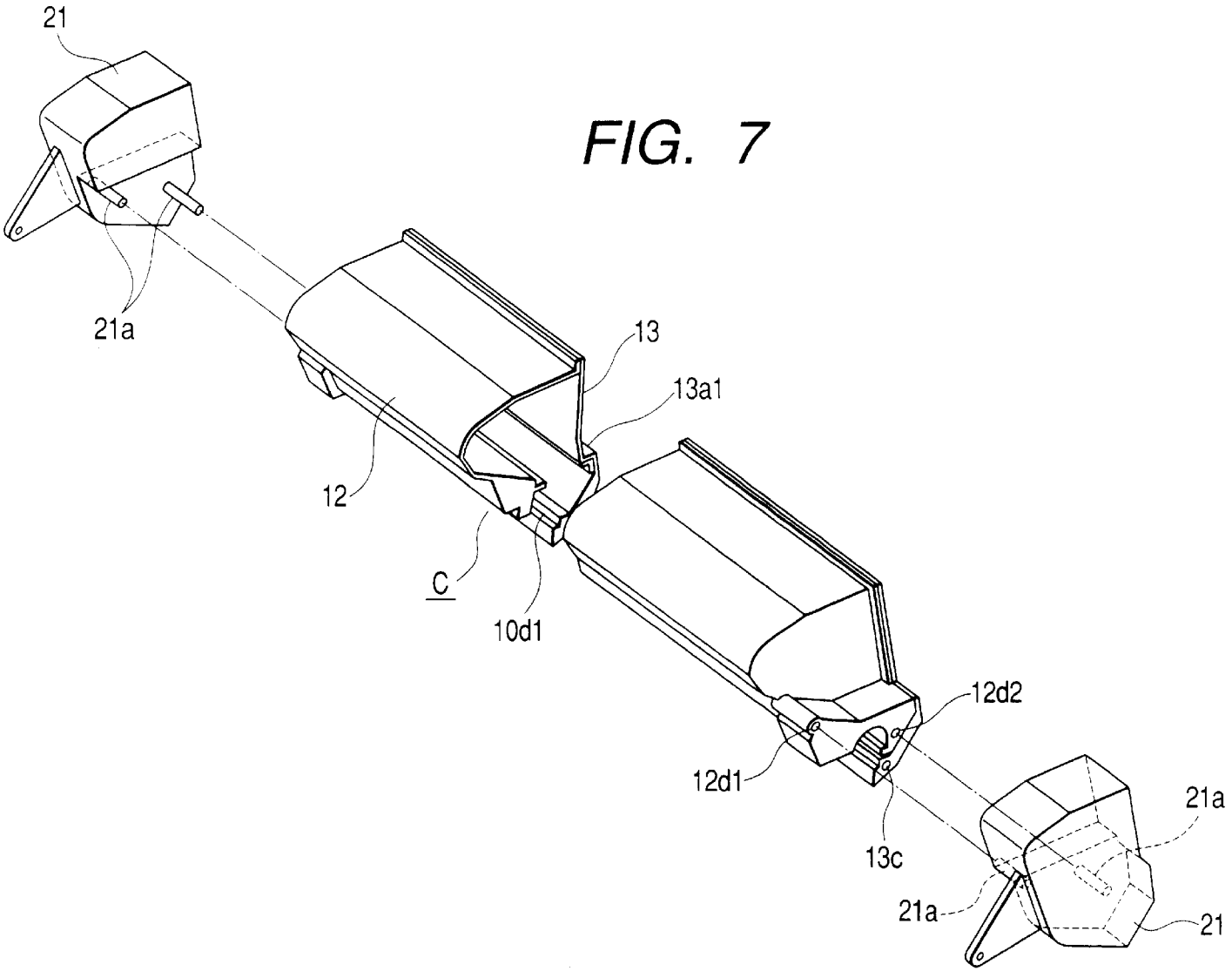
FIG. 7 is a view illustrating the assembling of the toner developing frame body and the toner developing wall member by coupling.

Next, the constitution of the developing frame C will be described by referring to FIGS. 5 to 7. FIG. 5 is a sectional view illustrating the developing means; FIG. 6 is a view illustrating the separated state of the toner developing frame body and the toner developing wall member; and FIG. 7 is a view illustrating the assembling of the toner developing frame body and the toner developing wall member by coupling.

As shown in FIGS. 5 and 6, the developing frame C includes the toner chamber 10*a* and the developing chamber 10*b*, which are constructed by coupling the toner developing frame body 12 and the toner developing wall member 13 to each other.

The toner developing frame body 12 serves as a main body for constituting the toner chamber 10*a* and the developing chamber 10*b*, and has a toner chamber portion 12*b* for forming the toner chamber 10*a* above the boundary of a seal attaching portion 12*a* having a toner supplying opening 12*a*1, and a developing chamber portion 12*c* for forming the developing chamber 10*b* below the seal attaching portion 12*a*. Openings are provided by opening the same surface wall portions 12*b*1 and 12*c*1 of the toner chamber portion 12*b* and the developing chamber portion 12*c*. The toner chamber portion 12*b* is formed to be wider in an opening side, and a toner filling opening (not shown) is provided in one side face of a longitudinal direction.

The toner developing wall member 13 is connected to the open wall part of the toner developing frame body 12, and includes a toner wall portion 13*a* and a developing wall portion 13*b*, which are integrally provided respectively to be connected to the open surface of the toner chamber 10*a* of the toner developing frame body 12 and to the open surface of the developing chamber 10*b*. In the boundary between the toner wall portion 13*a* and the developing wall portion 13*b*, a concave portion 13*a*1 is formed in such a way as to recess the toner wall portion 13*a* with respect to the developing wall portion 13*b*. The toner developing frame body 12 and the toner developing wall member 13 are made of resins by injection molding.

For assembling, the toner developing wall member 13 is joined to the open wall portion of the toner developing frame body 12, and the joined portion is welded to be connected. According to the embodiment, when the toner developing frame body 12 and the toner developing wall member 13 are coupled together, as shown in FIG. 7, end supporting member side covers 21 are attached to both longitudinal ends of the members 12 and 13, and these members are accurately positioned. Surfaces to be welded are two, i.e., the surface of the toner wall portion 13*a* and the surface of the developing wall portion 13*b*.

Thus, positioning boss holes 12*d*1 and 12*d*2 are provided in the side faces of both longitudinal ends of the toner developing frame body 12. Similarly, positioning boss holes 13*c* are provided in the side faces of both longitudinal ends of the toner developing wall member 13. Each end supporting member side cover 21 includes a boss 21*a*, which is provided as positioning means to fit in the boss holes 12*d*1 and 12*d*2 and 13*c*. The end supporting member side cover 21 also functions as positioning means when the developing roller 10*c* is attached to the toner developing frame body 12, and when the cleaning frame body 14 is connected to the toner developing frame body 12 having the toner developing wall member 13 welded thereto.

When the toner developing frame body 12 and the toner developing wall member 13 are coupled together, the wall portion 10*a*1 constituting the toner chamber 10*a* of the toner developing frame body 12 inclines toward the toner supplying opening 12*a*1. Accordingly, the toner in the toner chamber 10*a* can be fed to the developing chamber 10*b* without any waste. In addition, because of the concave portion 13*a*1 formed in the toner wall portion 13*a* of the toner developing wall member 13, a slope 13*a*2 inclining toward the toner supplying opening 12*a*1 is provided. The lower end 13*a*3 of this slope 13*a*2 is set to roughly coincide with the edge of the toner supplying opening 12*a*1, and the toner in the toner chamber 10*a* can be fed to the developing chamber 10*b* without any waste.

A sealing member 27 is detachably attached to the toner supplying opening 12*a*1 by adhesion, welding or the like. This sealing member 27 is removed by a user when the cartridge is used. Before the use of the process cartridge B, the opening 12*a*1 is closed. Thus, the leakage of the toner in the toner chamber 10*a* is prevented before the use of the process cartridge. In this state, the developing roller 10*c* and the developing blade 10*d* are attached to the developing chamber 10*b*, and then the toner chamber 10*a* is filled with the toner T to constitute developing means 10.

The process cartridge B is assembled by coupling the cleaning frame body 14 having the photosensitive drum 7, the cleaning means 11, and so on, attached thereto to the toner developing frame body 12 and the toner developing wall member 13 integrally provided as described above.

In this case, as shown in FIG. 5, the toner developing frame body 12 is shaped such that the toner chamber 10*a* can be positioned above the developing chamber 10*b*, and a part of the toner chamber 10*a* can be protruded to the photosensitive drum 7 side more than the developing chamber 10*b*.

The toner developing frame body 12 and the toner developing wall member 13 are both made of plastic, e.g., high-impact styrol or the like, and formed to be united. Accordingly, the capacity of the toner chamber 10*a* can be increased without enlarging the process cartridge B, making it possible to contain more toner. Even if the capacity of the toner chamber 10*a* is increased, since the toner chamber 10*a* of the toner developing frame body 12 is wide in the open side, the toner developing frame body 12 can be made of a resin or the like by injection molding.

(Welding/Joining Method for Developing Frame)

Figure 8:
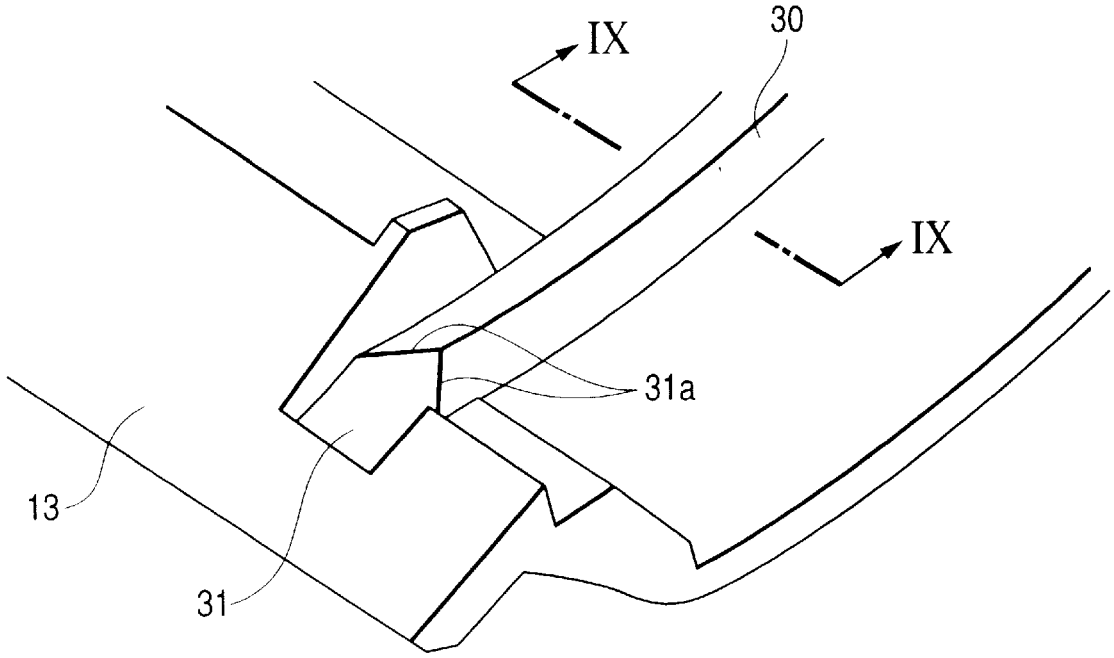
FIG. 8 is a detailed view of a state before the joining of a second frame.
Figure 9:
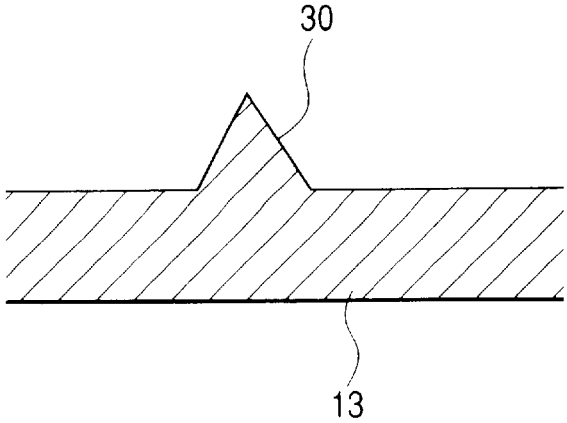
FIG. 9 is a sectional view of a welding rib.
Figure 10:
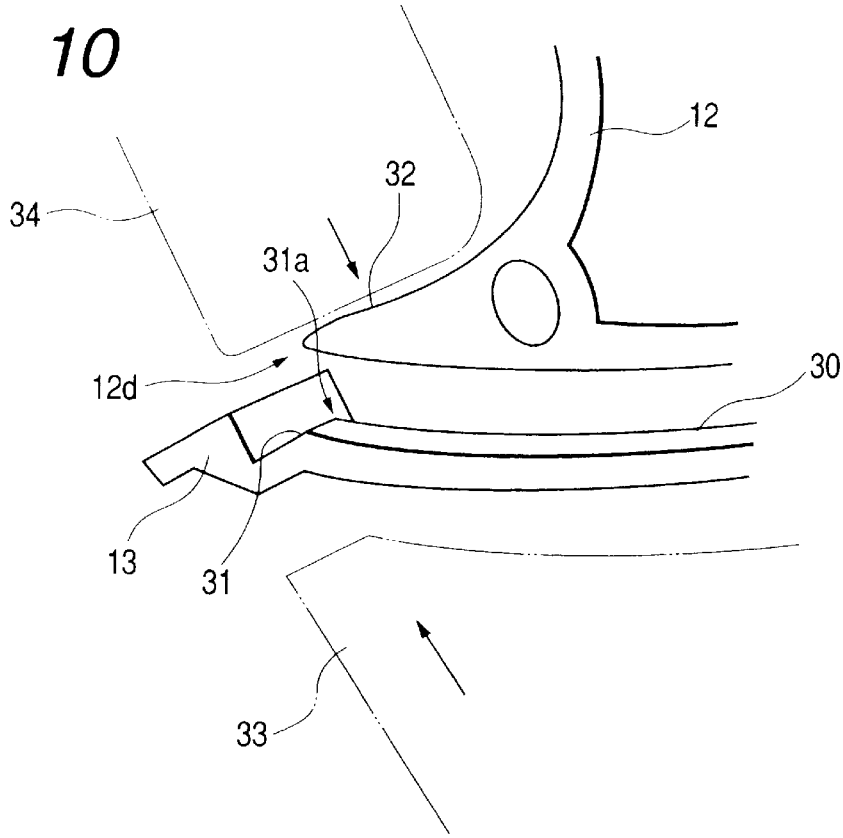
FIG. 10 is a sectional view of a state before the joining of first and second frames.
Figure 11:
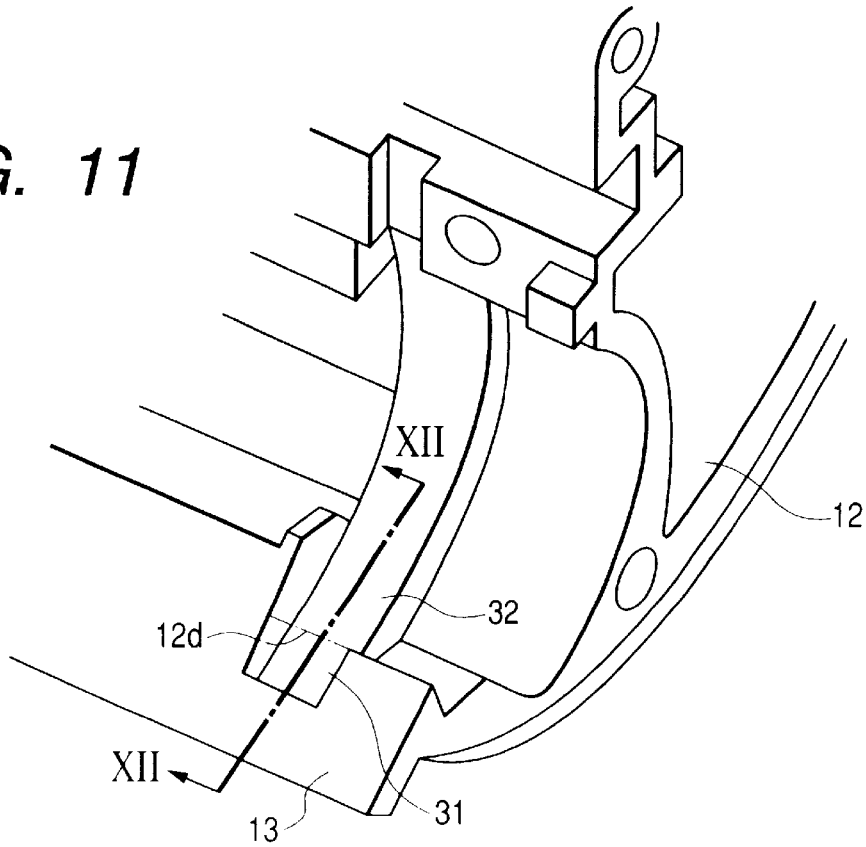
FIG. 11 is a detailed perspective view of a state after the joining of the first and second frames.
Figure 12:
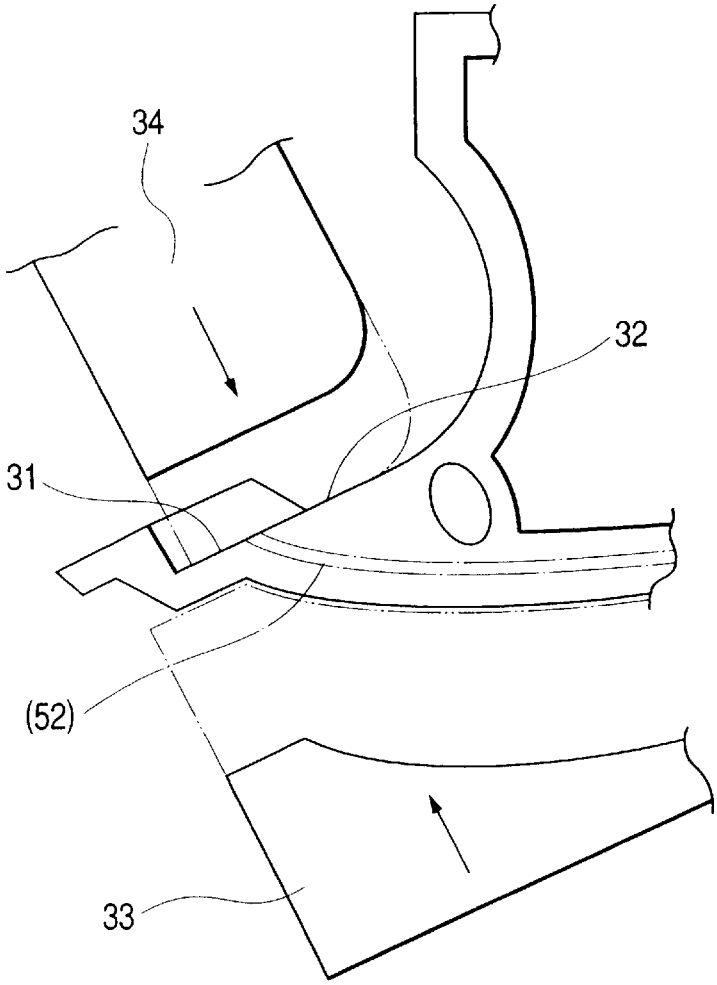
FIG. 12 is a sectional view of the state after the joining of the first and second frames.
Figure 13:
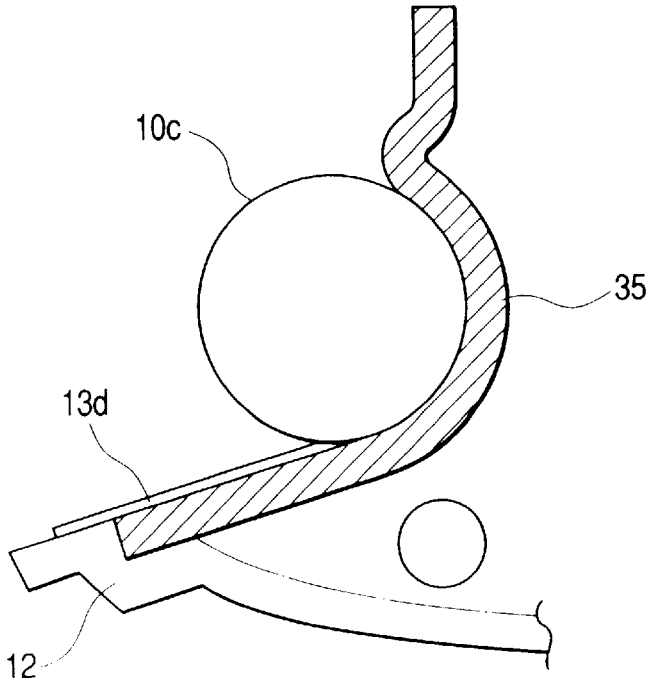
FIG. 13 is a view illustrating the assembled state of a sealing member and a developing roller.

Next, a method for welding/joining a developing frame will be described in detail by referring to FIGS. 8 to 13. FIG. 8 is a detailed view of a state before the joining of a second frame; FIG. 9 is a sectional view of a welding rib; FIG. 10 is a sectional view of a state before the joining of first and second frames; FIG. 11 is a detailed perspective view of a state after the joining of the first and second frames; FIG. 12 is a sectional view after the joining of the first and second frames; and FIG. 13 is a view illustrating the assembled state of a sealing member and a developing roller.

As shown in FIG. 8, a welding rib 30 is formed in the joined portion with the toner developing frame body 12 near both ends of the developing roller 10*c* of the toner developing wall member 13. The welding rib 30 is formed to be roughly triangular in section as shown in FIG. 9, which is a sectional view taken on line IX—IX of FIG. 8, continuous to a surface 31 for attaching a later-described sealing member 35 (see FIG. 8), and has a ridge line 31*a* in the boundary between the end surface of the welding rib 30 and the surface 31. As in the case of the surface 31, a surface 32 for attaching the sealing member 35 is formed in the toner developing frame body 12.

As shown in FIG. 10, the welding of the toner developing frame body 12 to the toner developing wall member 13 is carried out by a welding horn 33 for applying ultrasonic vibration, and a receiving base 34 used when the welding horn 33 is pressed into contact. For welding both members 12 and 13, first, positioning is performed by fitting the boss 21*a* of the end supporting member side cover 21 in each of the boss holes 12*d*1, 12*d*2 and 13*c*. The toner developing frame body 12 and the toner developing wall member 13 are held in the receiving base 34 over the surfaces 31 and 32 as shown in FIG. 10. Then, when pressure contact is made by using the welding horn 33 to apply ultrasonic vibration, the welding rib 30 is melted to weld and join the toner developing frame body 12 and the toner developing wall member 13 to each other.

In this case, the ridge line 31*a* of the surface 31 is also melted, and the receiving base 34 is pressed into contact with both of the adjacent surfaces 31 and 32. Thus, as shown in FIG. 11, and FIG. 12 which is a sectional view taken on line XII—XII of FIG. 11, the receiving base 34 is united with the end part 12*d* of the toner developing frame body 12 to form identical planes.

After the integration of the toner developing frame body 12 and the toner developing wall member 13, as shown in FIG. 13, the sealing member 35 for preventing the leakage of toner from the end of the developing roller 10*c* is adhered to both adjacent surfaces 31 and 32 by a double-coated adhesive tape or the like. Then, after a sheet member 13*d* for preventing the blowing-out of toner is attached below the developing roller 13*c* of the toner developing wall member 13, the developing roller 10*c* is assembled.

As described above, according to the embodiment, the developing frame C includes: the first frame (toner developing frame body 12) having the supplying opening (toner supplying opening 12*a*1) for supplying the toner from the toner containing portion (toner chamber 10*a*) to the developing area (developing chamber 10*b*) and the openings (wall portions 12*b*1 and 12*c*1); the second frame (toner developing wall member 13) for closing the openings of the first frame; the developing roller 10*c* as a developer carrying body for developing a latent image carried by the image bearing body (photosensitive drum 7); and the sealing member 35 fixed at least over the first and second frames for preventing the leakage of toner from the developing roller end. The first and second frames are joined together by welding and, in the joined portion of the first and second frames, the adjacent surfaces 31 and 32 for fixing the sealing member 35 are formed on substantially identical planes by welding.

As noted above, since the surface 31 of the toner developing frame body 12 and the surface 32 of the toner developing wall member 13 are melted together and formed on the identical planes, a gap between the sealing member 35 and the double coated adhesive tape can be eliminated, providing good toner sealing performance.

Another Embodiment

Figure 14:
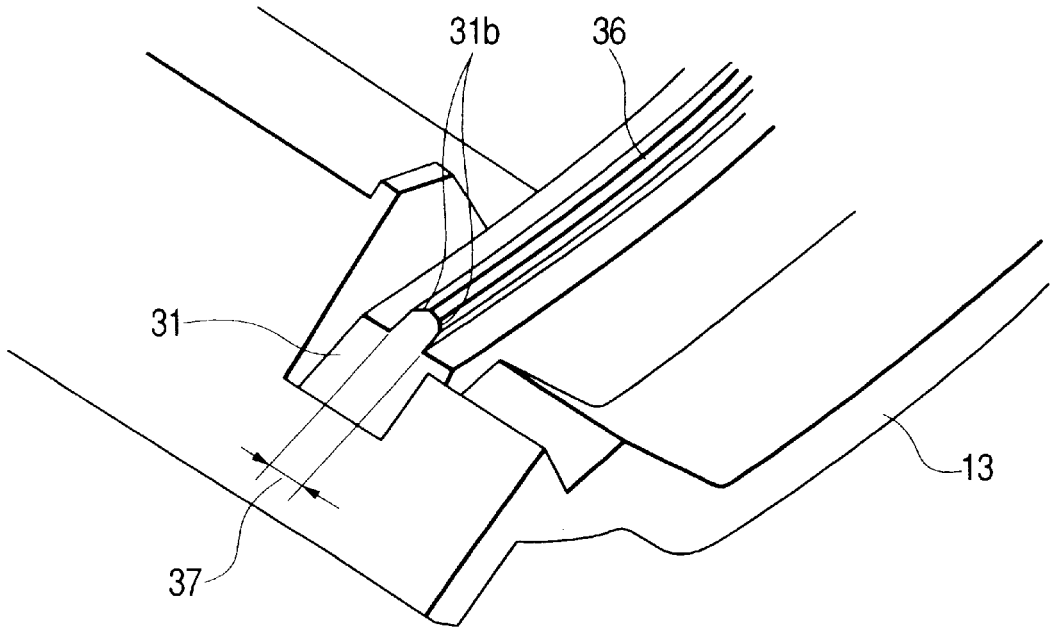
FIG. 14 is a detailed view of a state before the joining of a second frame according to another embodiment.
Figure 15:
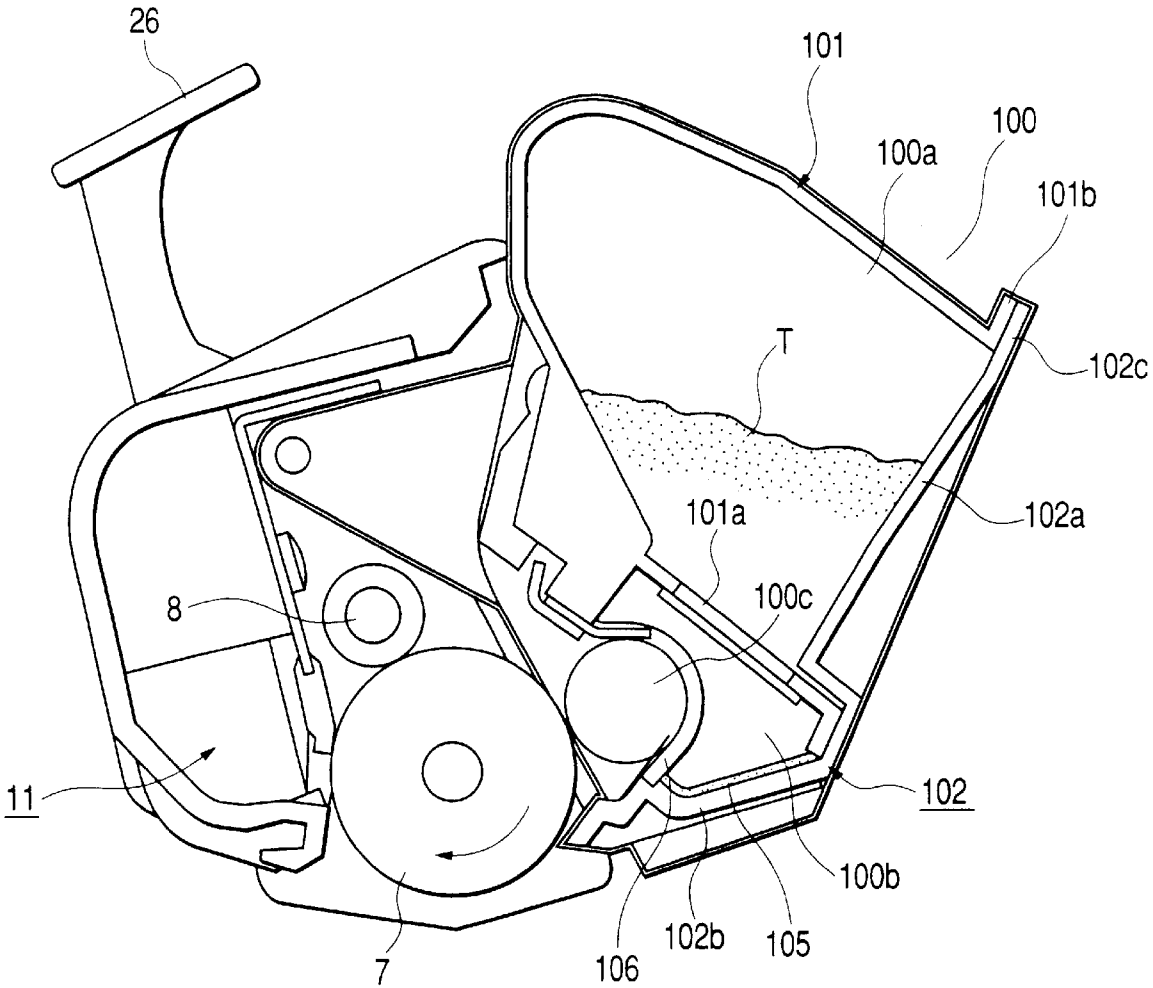
FIG. 15 is a view illustrating a process cartridge of a conventional example.
Figure 16:
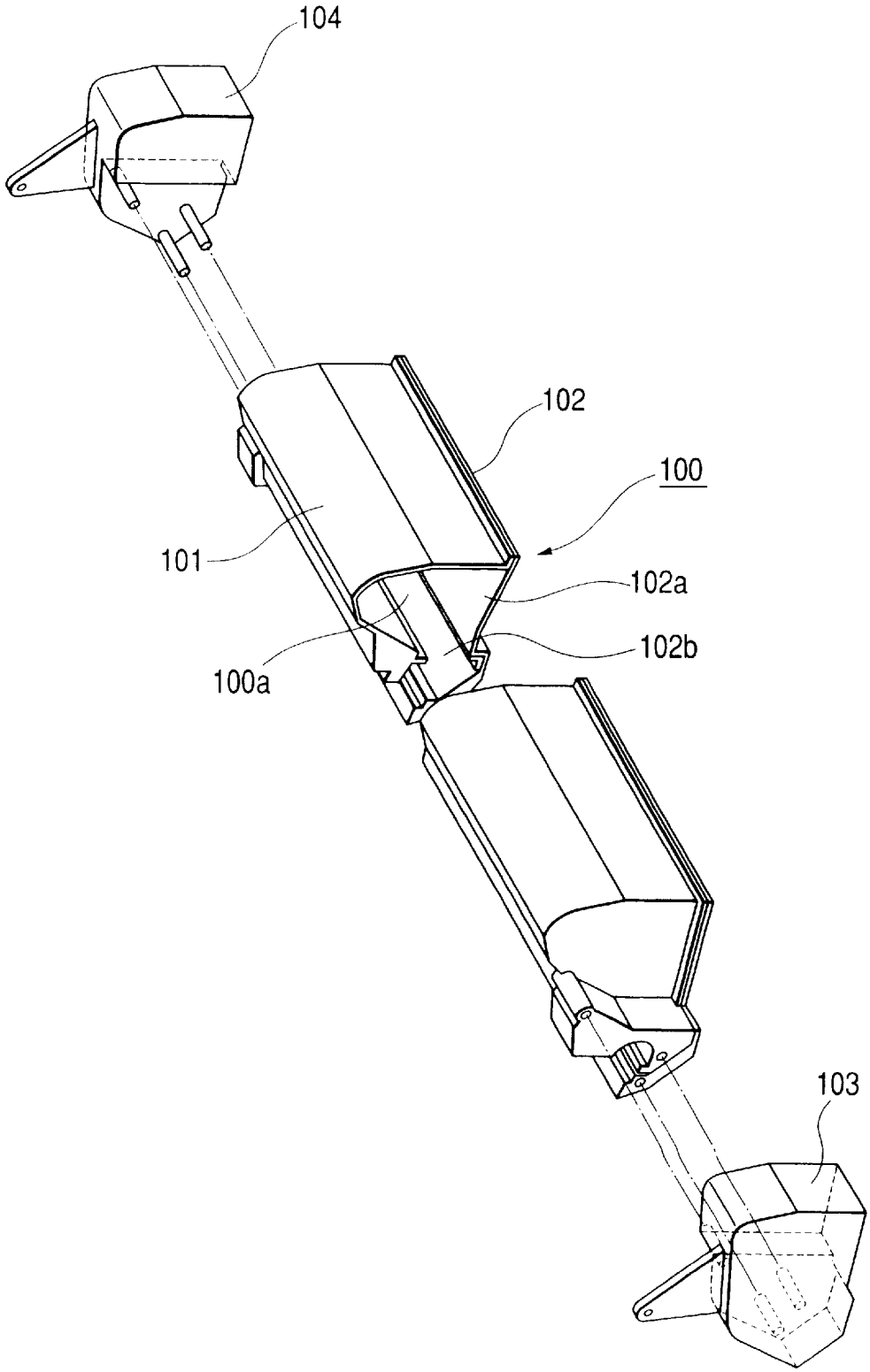
FIG. 16 is a view illustrating the constitution of a developing frame according to the conventional example.

Next, a description will be made of a developing apparatus and its assembling method according to another preferred embodiment of the invention by referring to FIG. 14. Parts similar to those in the first embodiment are denoted by like reference numerals, and a description thereof will be omitted.

In the above-described first embodiment, the welding rib 30 as the joined portion of the toner developing wall member 13 with the toner developing frame body 12 is formed to be roughly triangular, and the surface 31 has the ridge line 31*a*. However, a width 37 for melting-together of the tips of the two frame bodies may be set in such a way as to provide a proper width for pasting the sealing member 35. Therefore, according to the described embodiment, as shown in FIG. 14, the welding rib 36 of the toner developing wall member 13 is provided only to have a predetermined width roughly equal to a central one shown.

Because of the above-described arrangement, a ridge line 31*b* between the welding rib 36 and the surface 32 is also formed shorter than the ridge line 31*a*. However, if a part or all parts of the ridge line function to trigger melting-together of the toner developing frame body 12 and the toner developing wall member 13, and a part of the surface 31 functions as a welding rib, the two frame bodies can form identical planes after welding. Thus, an advance similar to that of the first embodiment can be provided.

Moreover, in the welding/joining method of the first embodiment, the surfaces 31 and 32 are supported by the receiving base 34. However, similar joining can be carried out by supporting the toner developing wall member 13 on the receiving base 34, and pressing the welding horn 33 into contact with the surfaces 31 and 32.

What is claimed is:

1. A developing apparatus comprising:

a developer carrying body for carrying a developer to develop an electrostatic image formed on an image bearing body by the developer;

a first frame having an opening and forming a part of a containing portion for containing the developer;

a second frame joined to said first frame to cover the opening, said second frame forming a part of the containing portion; and a sealing member for preventing leakage of the developer from a longitudinal end part of said developer carrying body, said sealing member being supported over said first and second frames, wherein said first and second frames are coupled together in a manner that adjacent surfaces of said first and second frames for supporting said sealing member form substantially identical planes.

2. A developing apparatus according to claim 1, wherein said first frame includes a supplying opening for supplying the developer from the containing portion to said developer carrying body.

3. A developing apparatus according to claim 1, wherein said first and second frames are coupled together by welding.

4. A developing apparatus according to claim 3, wherein a welded portion between said first and second frames is provided to be extended to the adjacent surfaces of said first and second frames for supporting said sealing member.

5. A developing apparatus according to claim 4, wherein said welded portion includes a welding rib.

6. A developing apparatus according to claim 1, wherein said sealing member is provided to be extended along a developer carrying direction of said developer carrying body.

7. A developing apparatus according to claim 1, wherein said sealing member is brought into contact with the longitudinal end part of said developer carrying body, and said developer carrying body has a roller shape.

8. A developing apparatus according to claim 1, further comprising a supporting member for supporting end parts of said first and second frames.

9. A developer apparatus according to claim 1, wherein said developing apparatus is provided in a process cartridge detachably attachable to a main body of an image forming apparatus with said developer carrying body.

10. A method for assembling a developing apparatus, comprising the steps of:

joining a first frame having an opening and forming a part of a containing portion for containing developer to a second frame forming a part of the containing portion in a manner such that the second frame covers the opening, said joining step causing adjacent surfaces of the first and second frames to form substantially identical planes; and supporting, over said adjacent surfaces, a sealing member for preventing a developer from leaking through a longitudinal end part of a developer carrying body which carries the developer to develop an electrostatic image on an image bearing body by the developer.

11. A method for assembling a developing apparatus according to claim 10, wherein said joining step includes a step of welding the first and second frames to each other.

12. A method for assembling a developing apparatus according to claim 11, wherein in said welding step, an ultrasonic vibration is applied while a surface of the second frame for supporting the sealing member is pressed into contact with a surface of an opposite side thereof by a welding horn, and the adjacent surfaces are received by a receiving base.

13. A method for assembling a developing apparatus according to claim 11, wherein in said welding step, an ultrasonic vibration is applied while the adjacent surfaces are pressed into contact with each other by a welding horn, and a surface of the second frame for supporting the sealing member and a surface of an opposite side thereof are received by a receiving base.

14. A method for assembling a developing apparatus according to claim 10, further comprising a step of supporting end parts of the first and second frames by a supporting member before said welding step.

* * * * *